United States Patent [19]

Harris

[11] 4,061,251

[45] Dec. 6, 1977

[54] METERED VALVE ASSEMBLY FOR DISPENSING DEVICES

[76] Inventor: Arthur M. Harris, c/o S.G. Militana, 9301 NE. 6th Ave., Miami Shores, Fla. 33138

[21] Appl. No.: 396,123

[22] Filed: Sept. 10, 1973

Related U.S. Application Data

[63] Continuation-in-part of Ser. No. 396,122, Sept. 10, 1973, abandoned.

[51] Int. Cl.[2] ..... B65D 83/14; G01F 11/28

[52] U.S. Cl. ..... 222/402.2; 222/402.22; 222/513

[58] Field of Search ..... 222/402.20, 402.21, 222/402.22, 513, 514

[56] References Cited

U.S. PATENT DOCUMENTS

| | | | |
|---|---|---|---|
| 2,693,983 | 11/1954 | Howell | 222/402.2 |
| 3,708,090 | 1/1973 | Harris | 222/402.22 |

*Primary Examiner*—Robert B. Reeves
*Assistant Examiner*—Frederick R. Handren

[57] ABSTRACT

A metered valve assembly for dispensing a predetermined volume of fluid from a receptacle containing fluid under pressure for each actuation of the dispensing apparatus having a valve chamber of predetermined capacity with a check valve controlling the flow of fluid under pressure from the receptacle to the valve chamber and a control valve for discharging the fluid contained in the valve chamber. The valve structures are so characterized that upon the closing off of the control valve, fluid under pressure in the receptacle will lift the normally seated check valve off its seat to fill said valve chamber with fluid under pressure. Upon the actuation of the dispensing apparatus to dispense fluid, the force maintaining the check valve on its seat is progressively increased until the control valve is opened to permit the discharge of that volume of fluid trapped in the volume chamber.

3 Claims, 4 Drawing Figures

METERED VALVE ASSEMBLY FOR DISPENSING DEVICES

CROSS REFERENCE TO A RELATED APPLICATION

This invention is a continuation in part of my application Ser. No. 396,122, filed on Sept. 10, 1973, now abandoned, for Non-Rotatable Actuator For Pressurized Liquid Dispensers.

BACKGROUND OF THE INVENTION

1. Field Of The Invention

This invention relates to metering valves and is more particularly directed to a metering valve for dispensing devices which valve permits the discharge of a predetermined amount of fluid as measured by the volume of an outlet chamber in a valve casing.

2. Description Of The Prior Art

This invention, a metering valve, is in particular an improvement of my U.S. Pat. No. 3,708,090, issued on Jan. 2, 1973, for Valve For Pressurized Liquid Dispenser. The conventional metering valves for metering a predetermined volume of fluids include structure which are complicated and as such are prone to malfunctioning or they contain spring elements which also have the propensity of not operating properly so as to permit a precise volume of fluid to be dispensed due to their being subject to tensile fatigue. Also, these metering devices utilize parts such as springs, etc. which must be made of metal thereby inhibiting the use of these valves in fluids that react when in contact with metal. The present invention contemplates avoiding the above objections to the use of a metering valve by accurately dispensing a predetermined volume of fluid at each operation of the dispenser without the use of springs or any metal parts.

SUMMARY OF THE INVENTION

Therefore, a principal object of the present invention is to provide a metering valve assembly for a pressurized fluid dispenser which dispenses a predetermined volume of fluid with each operation of the dispensing device without the danger of malfunction and consquent dispensing of a volume fluid greater than that intended by the metering valve.

Another object of the present invention is to provide a metering valve device for pressurized fluid dispensers, which device upon the actuation of the dispenser traps the fluid under pressure in a valve chamber by closing off the inlet valve to the valve chamber before the outlet thereof is opened to discharge the trapped fluid.

DESCRIPTION OF THE PREFERRED EMBODIMENT

Figure 1:
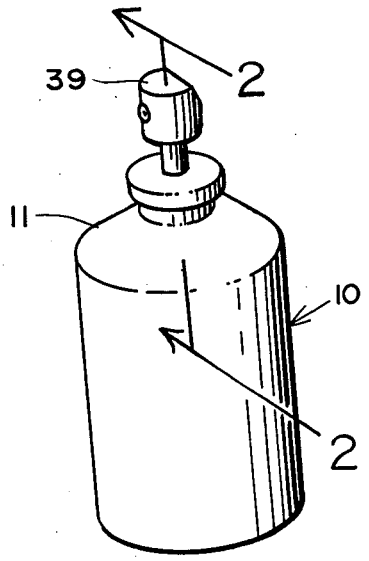
FIG. 1 is aperspective view of a container whose dispenser is provided with my metering valve assembly.
Figure 2:
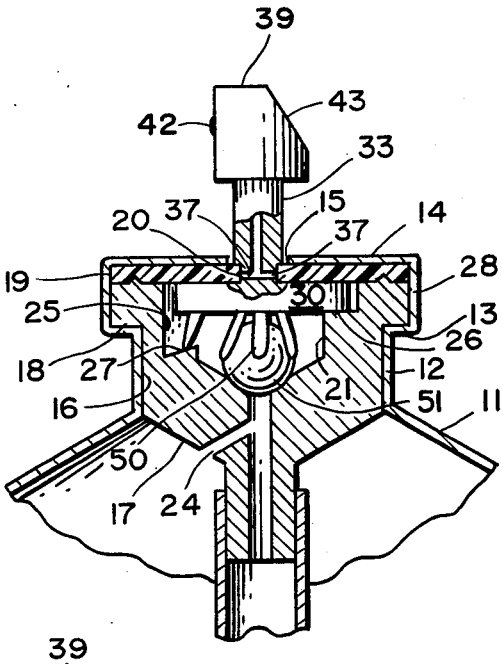
FIG. 2 is a cross sectional view taken along the line 2—2 of FIG. 1.

Referring to the drawing wherein like numerals are used to designate similar parts throughout the several views, the numeral 10 refers to a receptacle containing fluid water pressure having tapering side walls 11 forming the bottle portion (shown in Part) and a throat portion 12 extending upwardly therefrom. A cap portion is formed by an off-set 13 extending outwardly to a vertical wall portion 28 and enclosed by a top wall 14. In the center of the top wall 14 is an opening 15 which communicates with a chamber 16 formed by the cap 14 and throat portion 12.

Within the chamber 16 there is a valve housing 17 shaped to fit therein with a shoulder portion 18 resting on the off-set 13 of the bottle 10. Positioned in the chamber 16 between the valve housing 17 and the cap 11 is a resilient valve seat 19 having a centrally disposed opening 20 in alignment with the opening 15 in the cap 11.

The valve housing 17 is provided with a centrally disposed chamber 21, having an inclined bottom wall 42 and a valve seat 29 that communicates with a downwardly extending nipple 22 to which is connected a dip tube 23 extending downwardly to a position short of the bottom of the container 10 where it is immersed in pressurized liquid to be dispensed. A cappillary opening 24 may be provided in the valve housing 17 to permit vapor to flow from the container 10 into the valve chamber 16 to be dispensed with the liquid when the valve assembly is in its open position.

The upper portion of the valve housing 17 is provided with a counterbore 25 of diameter larger than that of the chamber 21 to form a shoulder 26 at one side thereof. The counterbore 25 slopes downwardly at an inclined angle from the shoulder 26 to form a sloping shoulder portion, its highest portion indicated at 26 and its lowermost at 27. The shoulder 26 operates as a fulcrum for a rigid valve disc 30 that is normally in contact relation with the resilient valve seat 19. The valve disc 30 is provided with a resilient leg 31 that yieldingly maintains the valve disc 30 seated against the valve seat 19 to close-off the opening 20.

Extending upwardly of the valve disc 30 at its central portion and received by the opening 20 is a valve stem 32 whose diameter and height is equal to those of the opening 20 in the valve seat 19 so as to fit therein and seal the opening. Extending upwardly of the top wall 11 is a main valve stem 33 whose diameter is equal to that of the opening 15 in the top wall 14 and whose lower end portion is received therein. At the top portion of the cylindrical main stem 33, one side is truncated to form a flat side wall 34 and shoulder 35. An axially disposed duct 36 extends through the full length of the main stem 33 and communicates with a plurality of radially extending bores 37 at the mid-portion of the valve stem 32.

The duct 36 communicates with a duct 38 extending upwardly in an actuator 39. The actuator 39 that is mounted over the free end of the main valve stem 33 is provided with a cavity 40 having an identical cross sectional shape and size as that of the top portion of the main valve stem 33 over which it fits. The mating flat wall 34 of the valve stem 33 and that of the cavity 40 of the actuator 39 prevent any relative rotational movement between the actuator 39, valve stem 33 and valve disc 30. A duct 41 extends horizontally connecting the duct 38 with an outlet nozzle 42 positioned on the side wall of the actuator 39. The nozzle 42, resilient leg 31 of the valve disc 30 and a thumb receiving wall portion 43 on the actuator 39 are all coplanar lying in a plane passing through the axis or center of the receptacle 10.

Extending downwardly from the mid-portion of the rigid valve disc 30 is a plurality of resilient fingers 50 preferably three or four in number symmetrically disposed about a circle with the ends of the fingers yieldingly engaging a ball valve 51 at all times. When the valve disc 30 is in its closed position as shown by FIG. 1, the resilient fingers 50 engage the ball valve only so firmly whereby the pressure of the fluid in the container 10 will lift the ball valve 51 off the valve seat 29 to permit the valve housing chamber 21 and counterbore 25 to become filled with the fluid so that the pressure on each side of the ball valve 51 will be equalized. At this time the weight of the ball valve 51 will become seated on the valve seat 29.

Figure 3:
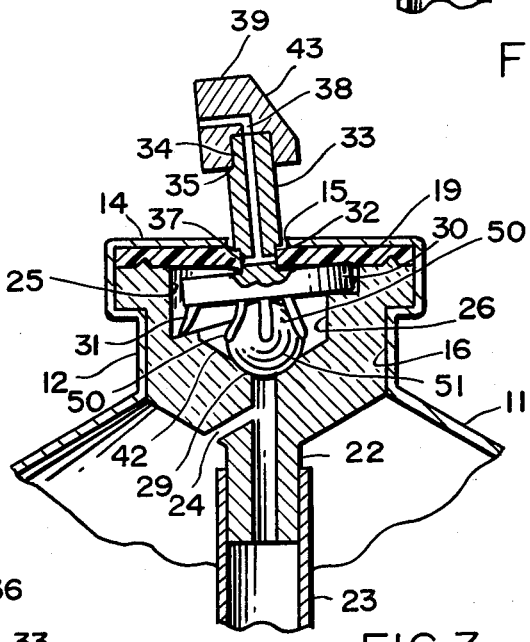
FIG. 3 is a similar view with the actuator commencing to be tilted, the valve remaining seated and the discharge outlet in a closed position thereby trapping the fluid in the valve chamber.
Figure 4:
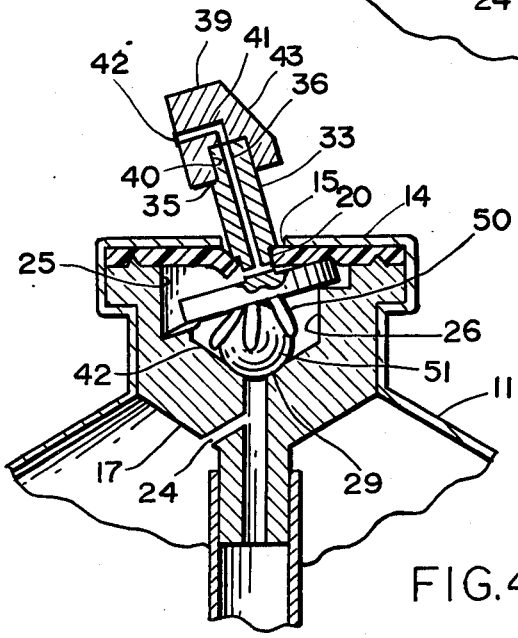
FIG. 4 is a similar view showing the complete tilting of the actuator to dispense the trapped fluid in the valve chamber.

Immediately upon the application of thumb pressure on the surface 43 of the actuator 39, the valve disc will pivot downwardly in the valve chamber 21 swinging about the shoulder 26 as a fulcrum. This causes the resilient fingers 50 to bear more firmly down on the ball valve 51 to retain the latter on its seat. At the same, as shown by FIG. 3, the orifices 20 have not been exposed to permit the escape of any of the fluid trapped in the valve chamber 21. Continued pressure on the actuator 39 will now swing the valve disc 30 against the force of the resilient support 31 to expose the orifices 20 as shown by FIG. 3 and fluid under pressure contained in the valve chamber 21 will be discharged through the nozzle 42. The ball seat 51 is maintained so firmly on the valve seat 29 by the resilient fingers 50 and contact by the valve disc 30 that no fluid under pressure in the container 10 can enter the valve chamber 21. Consequently, the only fluid to be discharged by a single tilting of the actuator 39 is the quantity contained in the valve chamber 29. If further fluid is desired, the actuator 39 must be released to permit the valve disc 30 to become seated as shown by FIG. 1. The ball valve 51 now is held only lightly against the valve seat 29 so that the higher pressure of the fluid in the container 10 will lift the valve 51 off the seat to fill the valve chamber 21 again ready to be discharged when the actuator 39 is again tilted. It is to be noted that with each actuation of the actuator 39, a certain volume of fluid is discharged as determined by the capacity of the valve chamber 21.

What I claim as new is:

1. In a receptacle for pressurized liquid having a cap portion, a resilient valve seat adjacent said cap portion, a rigid valve disc in contact relation with said resilient valve seat, an opening in said cap and said resilient valve seat for the passage of liquid under pressure from said receptacle, a valve housing mounted in said receptacle, said housing having a chamber, a second valve seat and an inclined shoulder, said valve disc engaging said shoulder at the highermost position as a fulcrum, a valve stem secured to said valve disc extending upwardly through said openings, an actuator mounted on said valve stem, said actuator having a discharge outlet and a thumb receiving surface on opposite sides thereof, said outlet, said thumb receiving surface and said fulcrum being in substantial coplanar relation, a duct extending axially of said valve stem communicating with said outlet and terminating adjacent said valve disc, a further duct extending radially of said valve stem connecting said first named duct and engaging said resilient valve seat at said opening when said valve disc is in a closed position, a check valve positioned in said valve chamber on said second valve seat and a plurality of elongated and substantially resilient members extending from said rigid valve disc engaging said check valve and yieldingly maintaining said check valve on said seat.

2. The structure as recited by claim 1 wherein said check valve comprises a ball and said valve chamber having side walls extending upwardly of said second valve seat.

3. The structure as recited by claim 2 wherein said resilient members are formed in a substantial circle for engaging said ball check valve.

* * * * *